US006095878A

United States Patent [19]

Van Balen

[11] Patent Number: 6,095,878

[45] Date of Patent: Aug. 1, 2000

[54] ADJUSTABLE OARLOCK PIN AND RIGGING ASSEMBLY

[75] Inventor: Gary Van Balen, Wexford, Pa.

[73] Assignee: 7v2 Corporation, Wexford, Pa.

[21] Appl. No.: 09/252,570

[22] Filed: Feb. 18, 1999

Related U.S. Application Data

[63] Continuation-in-part of application No. 08/915,900, Aug. 21, 1997, Pat. No. 5,873,757.

[51] Int. Cl.[7] ..... B63H 16/06

[52] U.S. Cl. ..... 440/105; 440/106

[58] Field of Search ..... 440/101, 104, 440/105, 106, 107, 108, 109; 248/188.4

[56] References Cited

U.S. PATENT DOCUMENTS

| | | | |
|---|---|---|---|
| 421,806 | 2/1890 | Bailey | 440/106 |
| 468,960 | 2/1892 | Vondersaar . | |
| 700,827 | 5/1902 | Rollins . | |
| 1,213,233 | 1/1917 | Morton . | |
| 2,550,625 | 4/1951 | Vick . | |
| 3,898,950 | 8/1975 | Martin . | |
| 4,352,667 | 10/1982 | Neville . | |
| 4,411,214 | 10/1983 | Horiuchi . | |
| 4,516,941 | 5/1985 | Reid . | |
| 4,889,509 | 12/1989 | Pohlus . | |
| 5,324,218 | 6/1994 | Rijnders . | |
| 5,340,258 | 8/1994 | Simon | 411/535 |
| 5,474,008 | 12/1995 | Vespoli et al. . | |
| 5,881,979 | 3/1999 | Rozier, Jr. et al. | 248/188.4 |

*Primary Examiner*—Stephen Avila
*Attorney, Agent, or Firm*—Arnold B. Silverman; Eckert Seamans Cherin & Mellott, LLC

[57] ABSTRACT

An oarlock for a rowing shell has an elongated housing with a screw member secured therewithin for rotational movement, but not axial movement therewithin. At least one guide member is secured within an elongated slot member and is threadedly secured to the screw member, such that rotation of the screw will cause responsive movement of the guide member or members within the slot or slots. By rotatably securing the oarlock either below a sole guide member or between the guide members around the exterior of the housing, rotation of the screw will effect translational movement of the oarlock pin to facilitate desired adjustment thereof. A manually rotatable adjustment element permits rotation of the screw while the rowing shell is in the water to thereby permit adjustment to the rowing conditions, such as the weight and size of the rower and water conditions. A rigging has struts securing the rigger to the rowing shell and the oarlock rotatably secured to the oarlock pin of the present invention. In another embodiment, a generally tubular member having a passageway for receiving an oarlock pin is externally threaded and received within an internally threaded sleeve member which is structured to lock a tubular portion of an oarlock on the exterior thereof so that rotation of the tubular member will effect responsive translation of the internally threaded sleeve and the oarlock. In a further embodiment, the oarlock tubular portion is internally threaded and receives the externally threaded tube with the internally threaded sleeve being eliminated.

30 Claims, 8 Drawing Sheets

ADJUSTABLE OARLOCK PIN AND RIGGING ASSEMBLY

RELATED APPLICATION

This application is a Continuation-in-Part of U.S. Ser. No. 08/915,900, filed Aug. 21, 1997, now U.S. Pat. No. 5,873,757.

BACKGROUND OF THE INVENTION

1. Field of the Invention

This invention relates to rowing shell rigging, and to a manually adjustable oarlock pin which supports the oarlock and provides a manual adjustment means for oarlock height adjustment for proper fit of the oar to the rower and rowing conditions.

2. Description of Prior Art

Rowing shells, consisting primarily of rowing boats and sculling boats, are moved through the water by oars. The oars transmit the power of the rower, drawing on strength and proper motions primarily from legs, arms, and back. The speed of the shell is determined by strength, technique, and the efficiency of the transmission of the rower's power through the oar to the water.

Among other things, the transmission of the rower's power is dependent on the relationship of the oar to the rower's body and the surface of the water. This relationship or geometry is determined by, among other things, the inboard and outboard lengths of the oar, stern and lateral pitch, and the height of the oarlock relative to the water. It is generally considered most efficient if, at the finish of the stroke, with the boat "set," the butt of the oar handle comes to a point an inch or two above the xiphoid process, which is the bottom of the rower's sternum. For that to happen, the fulcrum for the oar, the oarlock, must be at the correct height for the individual rower in his or her seat, for the particular boat. Additionally, the vertical angle of the oarlock, which controls the pitch of the blade of the oar is important and dependent on the rower's skill, wind and water conditions.

Various means have been suggested for improving the adjustability or efficiency of the operation of boats that are powered by rowers. See, generally, U.S. Pat. Nos. 4,889,509; 5,324,218; 5,474,008; 4,516,941; and 3,898,950. These patents do not, however, disclose the use of oarlock pins which may be readily adjusted in the water so as to accommodate the variations in the rower's size, weight, crew size, rower's position in the boat and other factors, such as water conditions.

In racing shells, the oarlock, which supports the oar, pivots on an oarlock pin which is supported by a rigger attached to the gunwale of the shell. The rigger and oarlock are designed to allow the oar to move as follows during each stroke: (a) to rotate about the longitudinal axis of the oarlock pin (allowing the oar to sweep through an arc which lies in an essentially horizontal plane); (b) to rotate about an axis which is perpendicular to the longitudinal axis of the oarlock pin (allowing the oar to sweep through an arc which lies in an essentially vertical plane); and (c) to rotate about the oar's own longitudinal axis (allowing the blade of the oar to be "feathered" or "squared" as necessary throughout the stroke).

Generally, the rigging which includes the rigger, oarlock pin, and oar, is adjustable to accommodate the difference in size and weight of rowers, different rowing techniques and different rowing conditions. In particular, the rigger and oarlock pin are designed to allow the oarlock to be adjusted in height above the water and distance from the centerline of the shell. The vertical angle of the pin is frequently also adjustable to facilitate adjusting the angle of the oarlock, which affects the "pitch" of the blade of the oar relative to the surface of the water.

The design and construction of most rigging is such that adjusting one aspect of the geometry of the rigging, like the height of the oarlock, requires a relatively complex sequence of adjustments to one or more of the rigger's structural elements. Sometimes, portions of the rigging must be partially or fully disassembled then reassembled to make an adjustment to the height of the oarlock. These adjustments usually require simple hand tools. Frequently, adjusting the height of the oarlock is a trial and error process until the right height is found for each individual rower, boat, crew weight and water condition. As a result of the difficulty in making such adjustments, they are normally made on land prior to placing the rowing shell in the water, or they are not made at all because it is not practical to make such adjustments each time a rower switches boats or seats in a boat. If the oarlock height is not properly adjusted for each individual rower, the efficiency of the crew and maximum sustainable speed of the rowing shell are reduced.

A primary concern for rowers of shells is adjusting the height of the oarlock so the hand on the inboard section of the oar moves through the proper plane while the blade of the oar moves through the water at the proper depth during the drive. Currently, adjusting the oarlock height on most shells is relatively complex and may require the use of tools, such as wrenches. See, generally, U.S. Pat. Nos. 4,352,667 and 4,411,214. One either adds or removes spacers, and loosen nuts and bolts and moves the oarlock pin, which supports the oarlock and permits it to rotate as needed, up or down through threads in the rigger assembly.

Prior art oarlock pins typically have one or more of the following disadvantages.

In prior art practices, it is necessary to adjust the oarlock height before the shell is placed on the water. This is because the position of the rower in the shell relative to the oarlock and oarlock pin, and the relative instability of rowing shells, makes it very difficult and often impossible for the rower to make any oarlock adjustments, except under emergency conditions. Usually, if oarlock height adjustments are necessary after the shell is placed on the water, a coaching launch is positioned next to the shell and the adjustments are made by an individual from the launch. This is very difficult and inconvenient for the shell crew and the coach. In addition, there is a risk that the rowing shell will be damaged by the launch as the two boats pitch and roll in the water in response to wind and waves. This can be a very difficult and time-consuming activity.

Currently oarlock height adjustments require using hand tools such as pliers, wrenches, screwdrivers or hex wrenches. Some types of shell rigging require partial disassembly and reassembly to make oarlock height adjustments.

Some current methods of oarlock height adjustment adversely affect other aspects of rigger geometry such as blade pitch. This usually requires readjustment of other aspects of rigger geometry after the height has been modified.

As the rower is not normally in the shell and the shell is not normally on the water when oarlock height is adjusted, measurements are often made between the oarlock and some reference point such as the rower's seat to help estimate the adequacy of adjustments. This is at best inaccurate because it does not consider such factors as the depth at which the shell rides in the water due to crew weight, for example.

A change in crew weight by switching crew positions or substituting rowers results in a change in the shell trim or how deep the shell rides in the water. This affects hand levels and may require oarlock height adjustments. The need for or magnitude of oarlock height adjustments will depend on the magnitude of the change in crew weight.

Some shells are rowed by a crew, each of a different physical size making it necessary to adjust the height of each oarlock to suit the needs of each individual rower. Oarlock height adjustments are difficult enough that they are often not made. Instead, the rower is forced to adjust his rowing technique to accommodate the improper oarlock height. This forces the rower to assume a less than optimal posture in the shell.

There remains, therefore, a very real and substantial need for an effective means for manually adjusting oarlock pin height while a boat is in the water in order to provide for efficient use of the power generated by the rower.

SUMMARY OF THE INVENTION

The present invention has met the above-described needs by providing a manually adjustable oarlock pin and a related rigging which permits ready adjustment of the oarlock pin height while the rowing shell is in the water.

In one embodiment of the invention, an oarlock pin for a rowing shell has a housing within which is a screw member which is rotatable, but cannot be moved in a translational direction. At least one guide member is adapted to be subjected to reciprocating movement within a slot. A pair of slots may be employed and may be positioned in general alignment with each other and generally parallel to the screw axis. Adjustment means which are fixedly secured to the screw at a position exteriorly of the housing are adapted to be rotated in a first direction to effect movement of the two guides in a first direction and rotated in the opposite direction to achieve movement of the guides in the other direction. The oarlock has a tubular bore which is received over the housing portion disposed between the two guides for relative free rotational movement with the housing. Responsive to axial rotation of the screws due to rotation of the adjustment means the guide members move and as a result raise or lower the oarlock responsively. In a preferred embodiment an upper bolt has external threads which are in threaded engagement with threads on the interior upper end of the housing and also has a bore which permits relative free rotational movement between the screw and the bolt. In this embodiment, the adjustment means is fixedly secured to the screw and an overlying lock nut secures the assembly.

In other embodiments, an externally threaded tubular member which receives an oarlock pin is threadedly engaged with an internally threaded sleeve which has a radially projecting lower portion to support a tubular portion of an oarlock and locking means such as nuts threaded to an externally threaded portion of the sleeve to secure the tubular portion of the oarlock and resist relative translational movement between the sleeve and the oarlock tubular portion with a knob for effecting rotation of the tubular externally threaded member to establish responsive translation of the oarlock. In a further embodiment, the oarlock tubular portion may have internal threads which are engaged by the external threads of a tubular portion.

The rigging may secure the oarlock pin to the gunwale or other portions of the boat by suitable struts.

It is an object of the present invention to provide a manually adjustable oarlock pin which permits the height of the oarlock to be changed by a rower of a rower's shell to suit his or her individual needs while the shell is in the water while not affecting the pitch of the oar.

It is another object of the present invention to facilitate such adjustment in height of the oarlock without affecting the geometry of the rest of the rigging which supports the oarlock.

It is a further object of the present invention to provide such an oarlock and associated rigger which is adapted for use with conventional rigging without requiring meaningful modification of the rigging.

It is another object of the present invention to provide a mechanically adjustable oarlock pin which makes it possible for rowers to adjust the height of the oarlock without requiring the use of tools, and without changing the blade pitch or other aspects of the supporting rigging.

It is another object of the present invention to provide an adjustable oarlock pin wherein adjustment can be easily accomplished while rowers are sitting in their seats in the normal rowing position with the rowing shell on the water floating at the depth and trim under which the rowers will row.

It is another object of the invention to provide such a system wherein, if height adjustment must be made on the water, there is no need for the coaching launch to approach the shell to assist with oarlock height adjustments increasing the safety for both boats.

It is another object of the invention to provide an adjustable oarlock pin which is self-contained with no loose pieces which might be dropped overboard or lost while making height adjustments.

It is a further object of the present invention to facilitate rapid and simplified manual adjustment of oarlock height.

It is yet another object of the invention to provide a manually adjustable oarlock which after the crew has been instructed in the proper use of the adjustable oarlock pin, little or no additional instruction or oversight will be needed prior to subsequent oarlock height adjustments.

It is yet another object of the present invention to provide a manually adjustable oarlock and associated rigger which has the ability to make quick oarlock height adjustments which will allow a single rowing shell to be rowed by many different crews.

These and other objects of the invention will be more fully understood from the following description on reference to the illustrations appended hereto.

DESCRIPTION OF THE PREFERRED EMBODIMENTS

As employed herein, the term "rowing shells" means sweep boats, sculls, canoes and other rowing boats, for which it would be convenient to adjust the height of the oarlock regardless of what means are employed to attach it to the boat.

As employed herein, the term "rigging" means the rigger and oarlock pin of a rowing shell.

Figure 1:
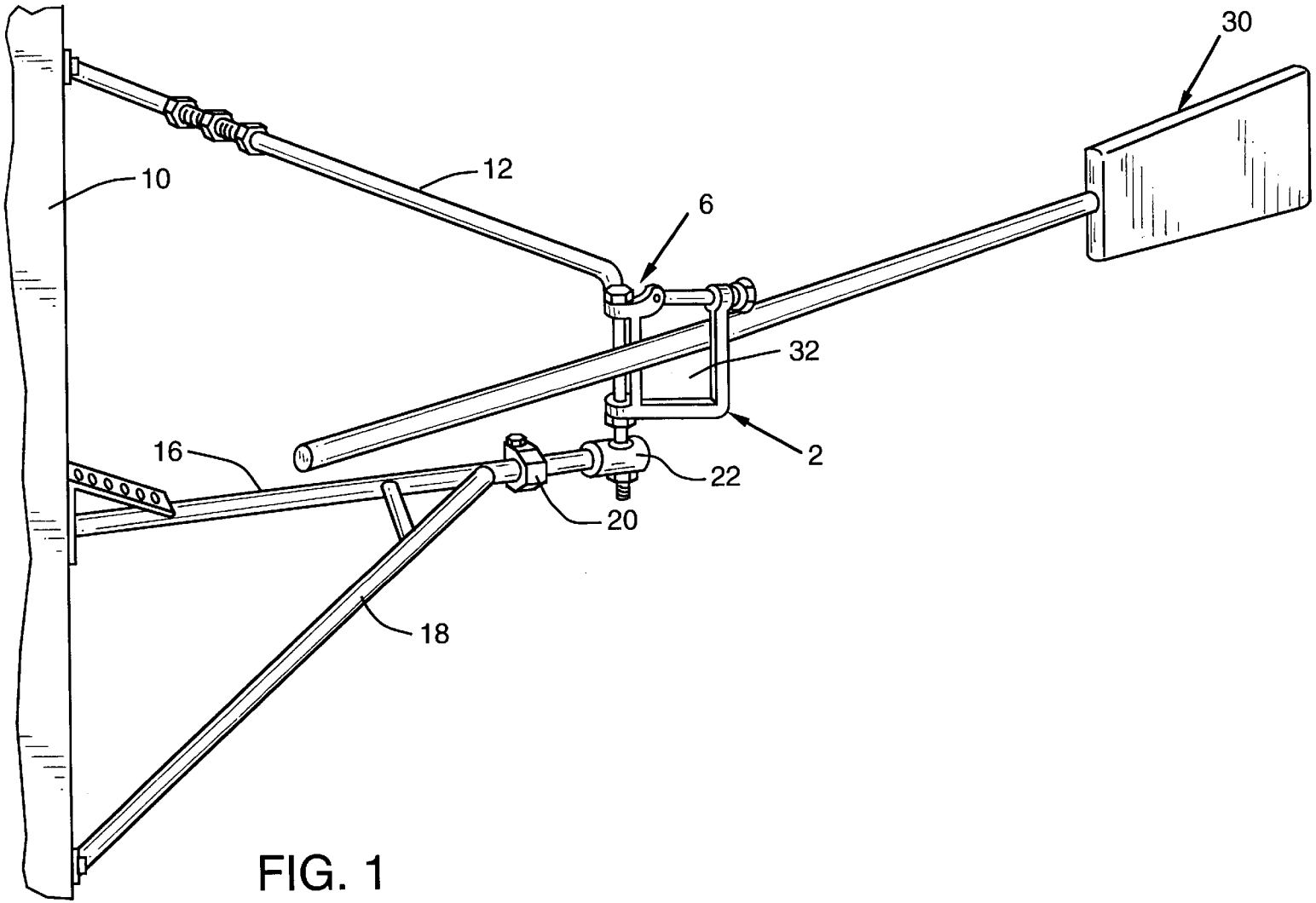
FIG. 1 is a partially schematic perspective view of a form of rigging incorporating an adjustable oarlock pin of the present invention.

Referring more specifically to FIG. 1, in the form shown an oarlock 2 which is rotatably secured to an oarlock pin 6 of the present invention and is fixedly secured to the gunwale 10 of a rowing shell by suitable struts, such as top strut 12, which is secured to the oarlock pin 6 and main strut 16 and front strut 18 which are joined at clamp member 20 and are secured by strut extension 22 to a lower portion of the pin. An oar 30 is received through the opening 32 in the oarlock. It will be appreciated that numerous other means for securing the oarlock to the rowing shell will be known to those skilled in the art may be employed.

Figure 2:
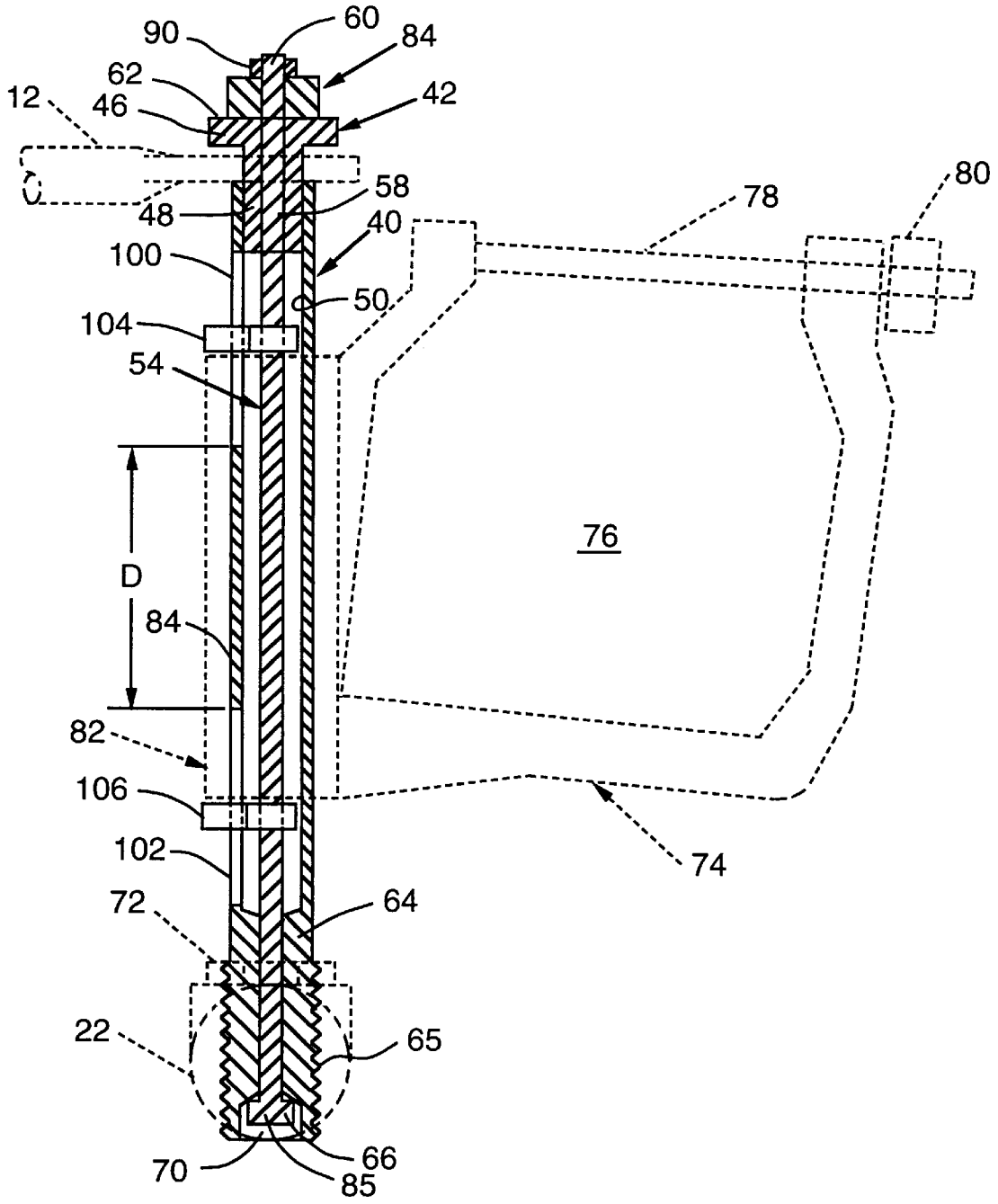
FIG. 2 is a cross-sectional illustration showing a preferred embodiment of the adjustable oarlock pin of the present invention with the oarlock and other portions of the associated apparatus being shown in broken lines.
Figure 3:
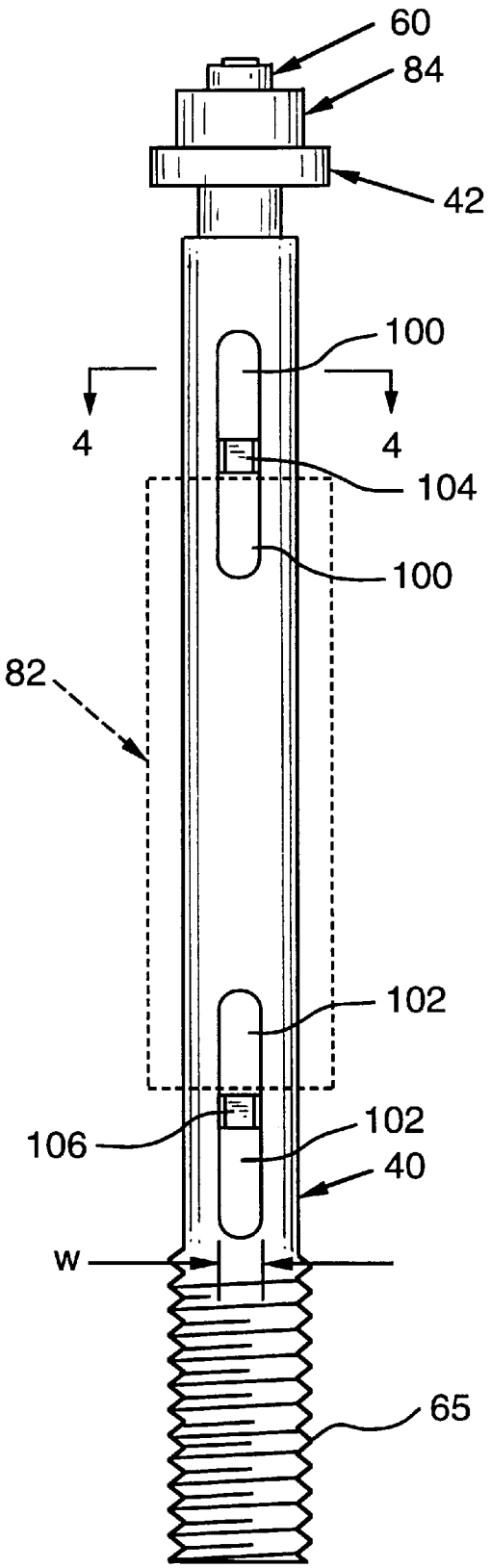
FIG. 3 is an elevational view of the oarlock pin of the present invention.
Figure 4:
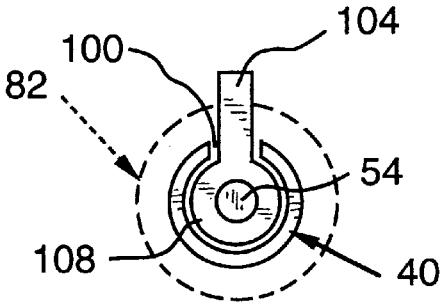
FIG. 4 is a cross-sectional illustration taken through 4—4 of FIG. 3.

Referring to FIGS. 2 through 4, the oarlock pin has a housing 40 which is generally tubular and may be made of any suitable material, such as steel, aluminum or stainless steel with or without an exterior finish coating. A screw 42 has a head portion 46 which generally would be secured in intimate contact with strut 12, but is shown spaced for clarity of illustration and a hollow shank portion 48 which is externally threaded and is secured to the upper portion of the inner surface 50 of the housing 40. An axially rotatable screw 54 is disposed within the housing 40 and passes through the unthreaded internal bore 58 of bolt 42 thereby permitting free relative rotation therebetween. The screw 54 has an extended portion 60 which projects beyond the upper surface 62 of bolt 42. The lower end of the bolt 54 is received within a restricted passageway defined by annular wall 64 of housing 40 and terminates in an enlarged head 66. Free rotation between the screw 54 and the wall 64 is permitted, but the opening defined by annular wall 64 is sufficiently small that substantial translational movement of the screw 54 in an axial direction is resisted. Also shown in FIG. 2 is the head 66 being received within a recess 70 of the housing 40. The upper strut 12 is secured to the oarlock pin by having bolt 42 pass through an opening (not shown) therein. Similarly, the connecting strut 22 is secured to the lower end of the oarlock pin by nut 72. The exterior of the lower portion of housing 40 has threads 65 and is threadedly engaged with strut element 22. Strut element 22 is, in the form shown, retained in place by lock nut 72 which is threadedly connected to the exterior of housing 40.

The oarlock 74 defines an oar receiving opening 76 which has its upper extremity closed by a pin or screw 78 which is secured in place by locking member 80 which may be a nut. The oarlock 74, in the form shown, also has a generally tubular portion 82 which is received over the exterior surface 84 of the housing 40 so as to permit free relative rotation therebetween.

At the uppermost portion of the screw 54 in the extension area 60, an adjustment knob 84 which is manually engageable is fixedly secured to screw extension 60. In this embodiment the fixed securement of the adjustment knob 84 to the screw extension 60 is effected by the nut 90. It will be appreciated that manual rotation of the adjustment knob 84 will produce responsive axial rotation of the screw 54.

A screwdriver slot 85 is preferably provided in head 66 to facilitate disassembly of the oarlock pin by removal of lock nut 90, adjustment knob 84 and bolt 42, thereby permitting axial withdrawal of screw 54 from housing 40.

As shown in FIGS. 2 through 4, threaded onto adjusting screw 54 and projecting through elongated first and second slots 100 and 102 in the side of housing 40 are two moveable guides 104, 106. The arrangement of moveable guides 104, 106 and slots 100, 102 resist meaningful rotation of moveable guides 104, 106 with adjusting screw 54 as it rotates axially. As the moveable guides 104, 106 are threaded onto the adjusting screw 54, the moveable guides 104, 106 translate along adjusting screw 54 in response to the screw 54 being turned by adjusting knob 84. While in the preferred embodiment a pair of guides 104, 106 are employed, a single guide may be employed if desired. For example, guide 106 which underlies and supports tubular portion 82 may be employed. Also, where more than one guide is employed, they need not be aligned with each other but may be circumferentially displaced with respect to each other while being at different elevations.

The elongated slots 100, 102, in the form shown, have their ends spaced from each other a distance D (FIG. 2) which is preferably about 1 to 3 inches. The slots 100, 102 are preferably elongated and have a width W which is greater than the width of the portions of the guide means 104, 106 which project exteriorly through slots 100, 102. The guide means 104, 106 are received, respectively, in slots 100, 102 for relative sliding movement. The slots 100, 102 are oriented generally in the same direction as the axis of screw 54 and are generally parallel to the axis. Moveable guides 104, 106 move together maintaining the distance between them which is set during assembly of the adjustable oarlock pin.

In practice, each rower in a shell would set his or her individual oarlock height as follows. The shell would be brought to a stop on the water with rowers sitting at the "finish" of the stroke, blades "squared" and floating at the proper depth in the water. While maintaining proper "set of the shell," each rower would turn the adjusting knob 84 at the top of his or her adjustable oarlock pin until the handle of his oar was at the proper "hand level" for his body.

It will be appreciated that with the present invention a significant improvement in rowing will result from the adjustable oarlock pin of this invention. It permits each rower to adjust the height of his or her own oarlock on the water while the shell is fully loaded and each rower is in "rowing position." In addition, the adjustable oarlock pin of this invention permits the adjustment of the height of the oarlock in the water, simply, quickly, and without tools, measurements or skill.

It will be appreciated that with the oarlock 74 having bore portion 82 freely rotatable about the housing 40 between guide members 104, 106 that movement of the guide members responsive to rotation of screw 54 causes upward or downward responsive movement of the oarlock 74. All of this is effected in an efficient manner on land or in water by rotation of adjustment knob 84. FIG. 4 shows the upper guide member 104 having an internally threaded bore defined by annular portion 108.

Figure 5:
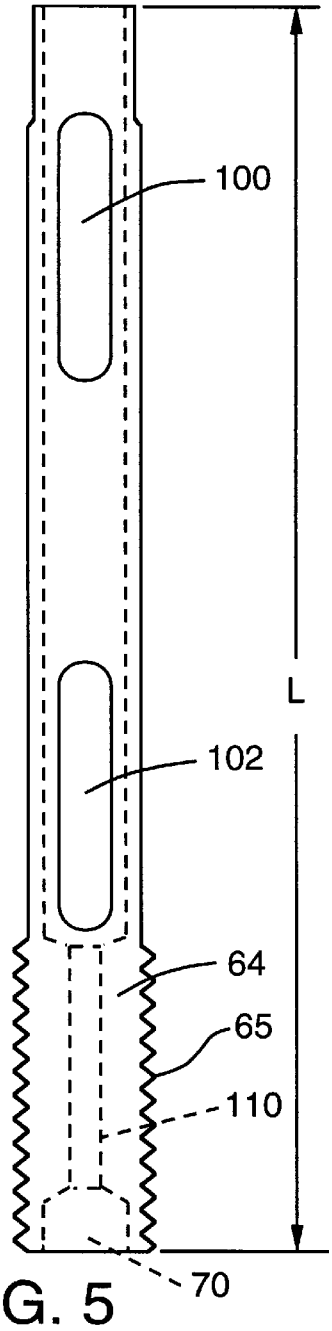
FIG. 5 is an elevational view of the housing of a preferred embodiment of the oarlock pin of the present invention.
Figure 6:
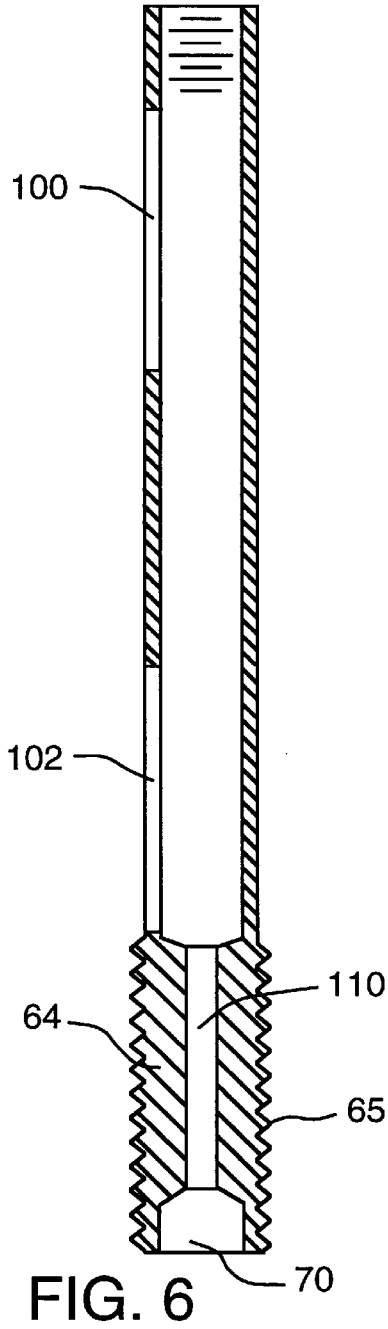
FIG. 6 is a cross-sectional illustration of the housing of FIG. 5.

With reference to FIGS. 5 and 6, details of the housing are shown. FIG. 5 shows the slots 100, 102, the inner wall 64 which defines the restricted passageway 110 through which the lower end of screw 54 passes. The slots 100, 102 may each have an axial extent which is about 1 to 2 inches.

Figure 7:
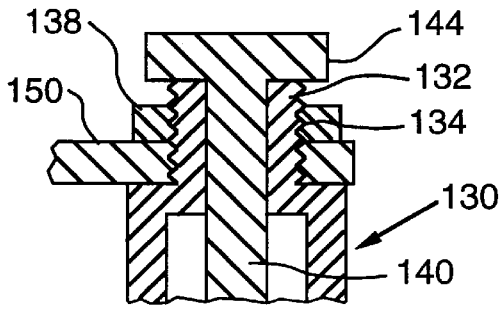
FIG. 7 is a fragmentary cross-sectional illustration of another embodiment of the housing.

In the modified embodiment of the housing 130, shown in FIG. 7, an externally threaded stud portion 132 is of reduced diameter with respect to other portions of the housing 130 and is formed as an integral extension thereof 132 having integrally formed external threads 134. The strut 150 is secured thereto by means of a lock nut 138. The projecting portion of the screw 140 is threadedly secured to knob 144.

Referring to the embodiment shown in FIG. 8, the rigging may be that shown and described in connection with FIGS. 1 and 2 with an overlying nut 172 being employed to secure the rigging to the assembly. An oarlock pin 174, which may be a conventional pin, is shown passing through the center of the assembly. The oarlock 180 has a tubular portion 182. For clarity of illustration, portions of the rigging and oarlock have been shown in dashed line.

Figure 8:
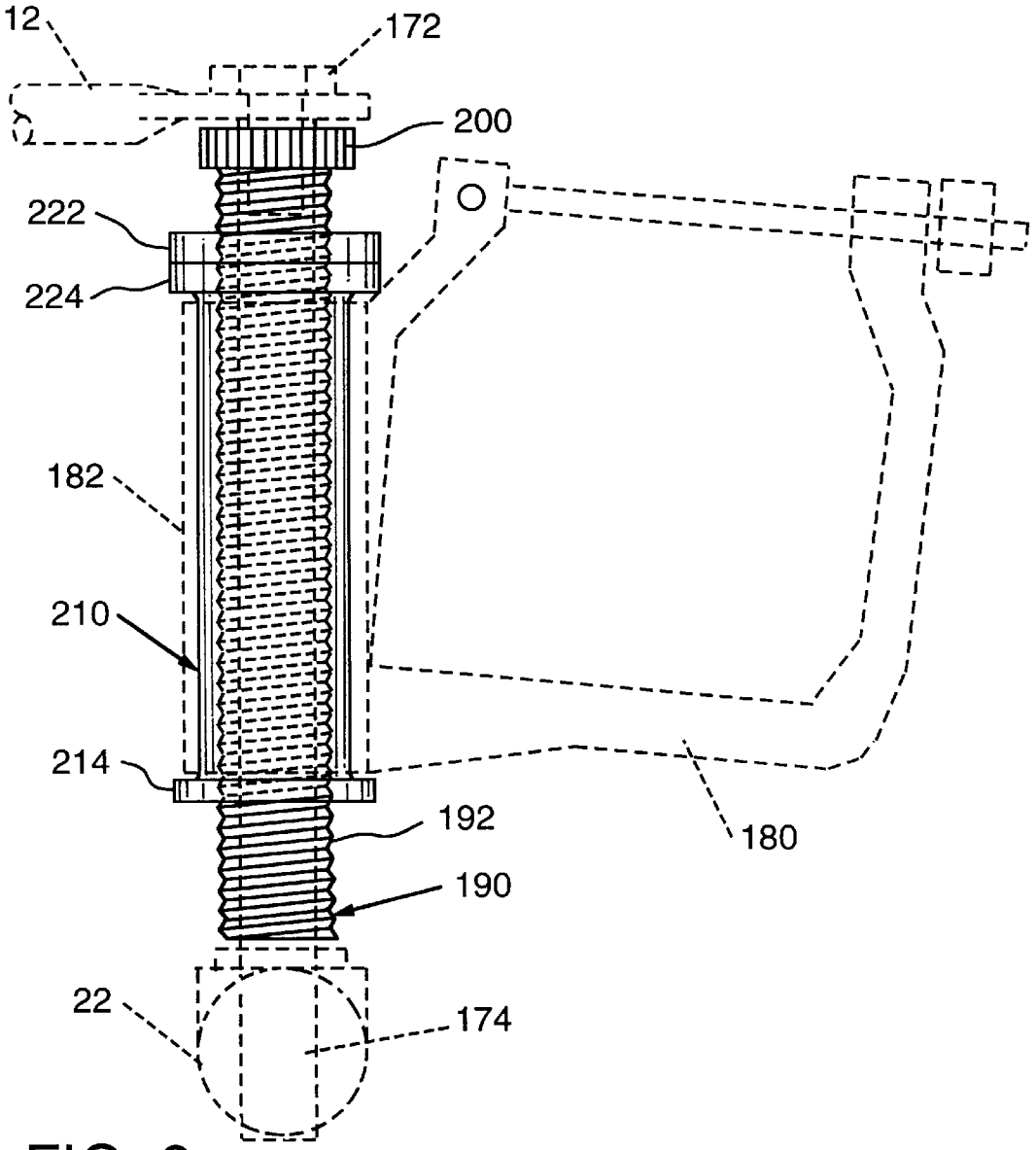
FIG. 8 is an elevational view illustrating another embodiment of the invention.
Figure 9:
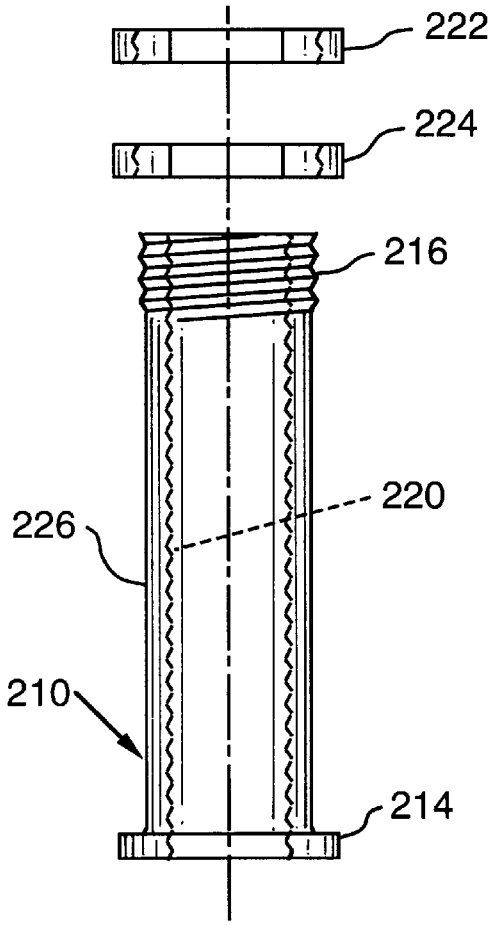
FIG. 9 is an exploded elevational view showing an internally threaded sleeve and associated locking nuts employable in the embodiment of FIG. 8.
Figure 10:
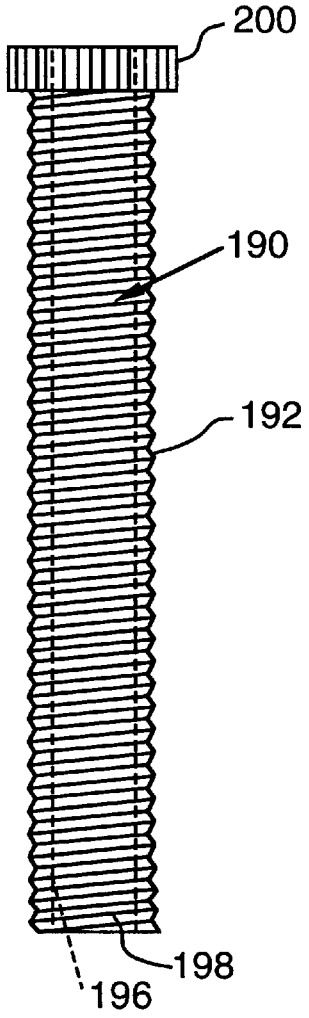
FIG. 10 is an elevational view of an externally threaded tubular member usable in the embodiment of FIG. 8.
Figure 11:
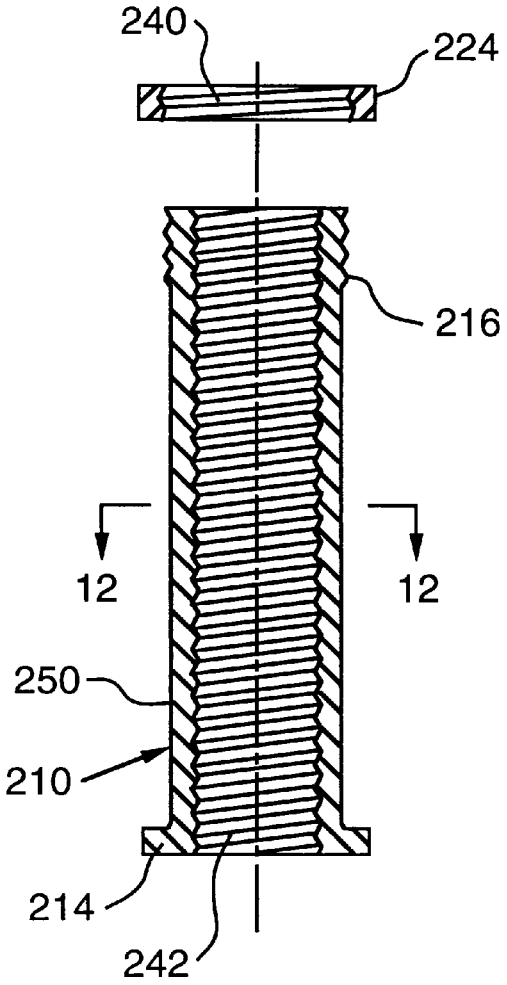
FIG. 11 is an exploded cross-sectional illustration of the internally threaded sleeve and a locking member of FIG. 9.
Figure 13:
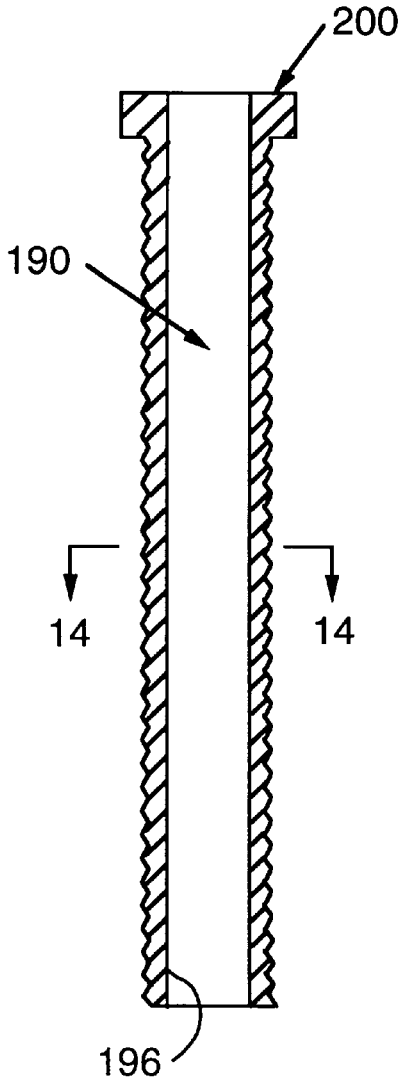
FIG. 13 is a cross-sectional illustration of the externally threaded tubular member of FIG. 10.
Figure 12:
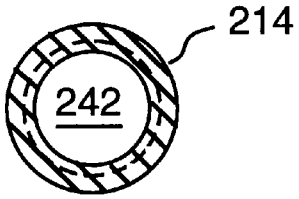
FIG. 12 is a cross-sectional illustration through 12—12 of FIG. 11.
Figure 14:
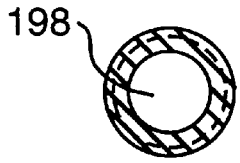
FIG. 14 is a cross-sectional illustration taken through 14—14 of FIG. 13.

Referring more specifically to FIGS. 8–10, it will be seen that a generally tubular member 190 has external threads 192, which in the form shown, are substantially coextensive with the tubular member 190. The tubular member 190 has a generally smooth inner surface 196 which defines an axial passageway 198 for receipt of oarlock pin 174 (FIG. 8). A knob 200 is disposed at or adjacent to an upper portion of the tubular member 190 and preferably is formed as a unit therewith such that rotation of said knob 200 will cause rotation of the tubular member 190. An internally threaded sleeve 210 has a lower radially enlarged preferably continuous annular flange 214 at its lower extremity and has external threads 216 at its upper end. The internal threads 220 are threadedly engaged with threads 192 of tubular member 190 and locking means which, in the form shown, are internally threaded nuts 222, 224 which are threadedly engaged with the external threads 216. A tubular portion 182 of the oarlock 180 is positioned in exterior surrounding relationship with respect to the exterior surface 226 of sleeve 210. This tubular portion 182 is restrained between the lower radially extending portion 214 and nuts 222, 224 to resist relative longitudinal movement between the internally threaded sleeve 210 and the tubular portion 182. The nuts 222, 224 also serve to resist undesired free rotation of the tubular portion 182 about internally threaded sleeve 210. In the alternative, other means may be provided to resist such rotation if desired. For example, a pair of diametrically opposed flat portions (not shown) may extend generally longitudinally along the exterior surface of sleeve 210 and cooperate with a pair of interior flat surfaces on tubular portion 182 to resist undesired free rotation of tubular portion 182 with respect to sleeve 210. When the knob 200 is rotated in a first direction, this will establish movement of the internally threaded sleeve 210 in a translational axial first direction and when the knob 200 is rotated in the opposite direction, translational movement of the internally threaded sleeve will be in the opposite direction. It will be appreciated that the radial extent of the lower radially extending portion 214 and the nuts 222, 224 are greater than the radial extent of the tubular portion 182 of the oarlock 180. As a result of the inter-relationship of the components, rotation of the knob will effect responsive vertical movement in one of two translational directions of the oarlock 180. FIGS. 11–14 show additional details of this embodiment of the invention with FIG. 11 showing the internal threads 240 on one of the nuts 224. Two nuts are preferably employed so as to facilitate locking action of the nuts on the sleeve resisting separation therefrom. The tubular externally threaded member 190 will be received within passageway 242 of the internally threaded sleeve 210. The internally threaded sleeve 210 has an exterior surface 250 which, in the form shown, is smooth as is internal surface 196 of externally threaded member 190.

In the form illustrated, knob 200 has a knurled exterior as shown in FIG. 10 and is integrally formed with the remainder of externally threaded tubular member 190.

While the exteriorly threaded tubular member 190 and the interiorly threaded sleeve 210, as well as the nuts 222, 224 may be made of any suitable material including metal, such as aluminum, it is preferred to make them from a resinous plastic material, such as high density polyethylene or ultra-high density polyethylene which may advantageously be injection molded.

It will be appreciated that the structure of the embodiment of FIGS. 8–14 may be employed with either a conventional standard oarlock pin, as represented by the reference number 174 in FIG. 8, or by a modified form of pin, if desired.

Figure 16:
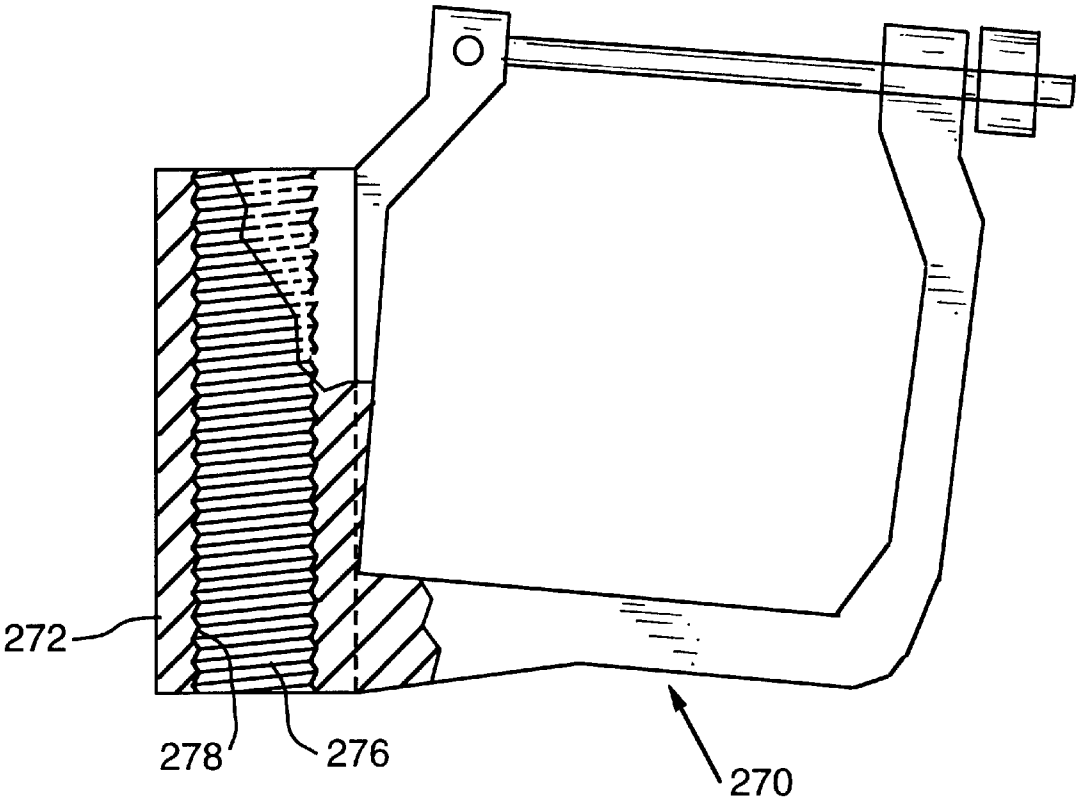
FIG. 16 is an illustration of an oarlock having an interiorly threaded tubular portion adapted to receive the tubular exteriorly threaded member of FIG. 15.
Figure 15:
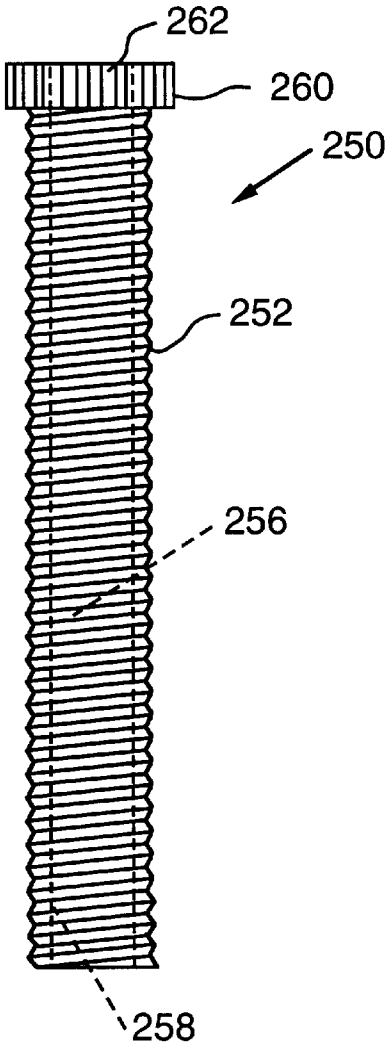
FIG. 15 is an elevational view of a form of exteriorly threaded tubular member usable in another embodiment of the invention.

Referring to FIGS. 15 and 16, a further embodiment of the invention will be considered. In this embodiment, an externally threaded tubular member 250 has threads 252 substantially coextensive with the member and an internal passageway 256 provided with a smooth surface 258 with an oarlock pin (not shown) to be received within the passageway 256. A knob 260 is positioned at the upper end and, in the form shown, has external knurling 262. Rotation of the knob, which preferably is integrally formed with the tubular member 250 effects responsive axial rotation of the tubular member. An oarlock 270 has a tubular portion 272 which has a passageway 276 and internal threads 278 adapted to be threadedly engaged with the exterior threads 252 of tubular member 250. It will be appreciated that the embodiment of FIGS. 15 and 16 does not require the use of internally threaded sleeve 210 or nuts 222, 224. The assembly may otherwise be secured to the rigging as in the other embodiments.

Whereas particular embodiments of the present invention have been described herein for purposes of illustration, it will be appreciated by those skilled in the art that numerous variations of the details may be made without departing from the invention as described in the appended claims.

What is claimed is:

1. An oarlock pin assembly for a rowing shell comprising a generally tubular member structured to receive an oarlock pin, said tubular member being externally threaded, an internally threaded sleeve member disposed exteriorly of said tubular member and being in threaded engagement therewith, said threadedly engaged tubular member and sleeve member being structured to move as a unit with respect to said oarlock pin during rowing, said internally threaded sleeve having an exterior surface structured to receive a generally tubular portion of an oarlock, and locking means for securing said tubular portion of said oarlock in fixed position with respect to said internally threaded sleeve.

2. The oarlock pin assembly of claim 1 including said tubular portion having an unthreaded inner surface.

3. The oarlock pin assembly of claim 1 including said tubular member being composed of a resinous plastic material.

4. The oarlock pin assembly of claim 3 including said internally threaded sleeve being composed of a resinous plastic material.

5. The oarlock pin assembly of claim 1 including the interior diameter of said externally threaded sleeve being larger than the external diameter of the oarlock pin which will pass therethrough.

6. The oarlock pin assembly of claim 4 including said tubular member and said interiorly threaded sleeve each being injection molded plastic.

7. An oarlock pin assembly for a rowing shell comprising a generally tubular member for receiving an oarlock pin, said tubular member being externally threaded, an internally threaded sleeve member disposed exteriorly of said tubular member and being in threaded engagement therewith, said internally threaded sleeve having an exterior surface for receiving a generally tubular portion of an oarlock, locking means for securing said tubular portion of said oarlock in fixed position with respect to said internally threaded sleeve, and said sleeve having a lower radially enlarged support for supporting said generally tubular portion of said oarlock.

8. The oarlock pin assembly of claim 7 including said sleeve having an upper portion which is externally threaded, and said locking means being nut means threadedly secured thereto.

9. The oarlock pin assembly of claim 8 including said nut means having a diameter greater than the exterior diameter of said sleeve.

10. The oarlock pin assembly of claim 8 including said nut means having two interiorly threaded nuts.

11. An oarlock pin assembly for a rowing shell comprising a generally tubular member for receiving an oarlock pin, said tubular member being externally threaded, an internally threaded sleeve member disposed exteriorly of said tubular member and being in threaded engagement therewith, said threadedly engaged tubular member and sleeve member being structured to move as a unit with respect to said oarlock pin during rowing, said internally threaded sleeve having an exterior surface for receiving a generally tubular portion of an oarlock, locking means for securing said tubular portion of said oarlock in fixed position with respect to said internally threaded sleeve, and a knob disposed at an upper portion of said generally tubular member for permitting manual rotation of said tubular member and responsive translational movement of said threaded sleeve.

12. An oarlock pin assembly comprising a generally tubular member structured to receive an oarlock pin, an oarlock pin disposed within said generally tubular member, said tubular member being externally threaded and having a generally smooth internal passageway within which said oarlock pin is disposed, an oarlock having an internally threaded generally tubular portion in threaded engagement with said tubular member, whereby rotation of said tubular member will effect responsive translational movement of said internally threaded tubular portion of said oarlock, and said threadedly engaged tubular member and tubular portion being structured to move as a unit with respect to said oarlock pin during rowing.

13. An oarlock pin assembly comprising a generally tubular member for receiving an oarlock pin, said tubular member being externally threaded and having a generally smooth internal passageway for receipt of said oarlock pin, an oarlock having an internally threaded generally tubular portion in threaded engagement with said tubular member, whereby rotation of said tubular member will effect responsive translational movement of said internally threaded tubular portion of said oarlock, said threadedly engaged tubular member and tubular portion being structured to move as a unit with respect to said oarlock pin during rowing, and a knob disposed at the upper end of said generally tubular externally threaded member for effecting rotational movement thereof.

14. The oarlock pin assembly of claim 13 including said externally threaded tubular member being composed of a resinous plastic material.

15. The oarlock pin assembly of claim 13 including said knob being integrally formed with said externally threaded tubular member.

16. Rigging for a rowing shell comprising a rigger having a plurality of struts secured to an oarlock pin, a generally tubular member for receiving an oarlock pin, said tubular member being externally threaded, an internally threaded sleeve member disposed exteriorly of said tubular member and being in threaded engagement therewith, said threadedly engaged tubular member and sleeve member being structured to move as a unit with respect to said oarlock pin during rowing, said internally threaded sleeve having an exterior surface for receiving a generally tubular portion of an oarlock, and locking means for securing said tubular portion of said oarlock in fixed position with respect to said internally threaded sleeve.

17. The rigging of claim 16 including a knob disposed at an upper portion of said generally tubular member for permitting manual rotation of said tubular member and responsive translational movement of said threaded sleeve.

18. The rigging of claim 16 including said tubular portion having an unthreaded inner surface.

19. The rigging of claim 16 including said tubular member being composed of a resinous plastic material.

20. The rigging of claim 19 including said internally threaded sleeve being composed of a resinous plastic material.

21. The rigging of claim 16 including the interior diameter of said externally threaded sleeve being larger than the external diameter of the oarlock pin which will pass therethrough.

22. The rigging of claim 20 including said tubular member and said interiorly threaded sleeve each being injection molded plastic.

23. Rigging for a rowing shell comprising a rigger having a plurality of struts secured to an oarlock pin, a generally tubular member for receiving an oarlock pin, said tubular member being externally threaded, an internally threaded sleeve member disposed exteriorly of said tubular member and being in threaded engagement therewith, said internally threaded sleeve having an exterior surface for receiving a generally tubular portion of an oarlock, locking means for securing said tubular portion of said oarlock in fixed position with respect to said internally threaded sleeve, and said sleeve having a lower radially enlarged support for supporting said generally tubular portion of said oarlock.

24. The rigging of claim 23 including said sleeve having an upper portion which is externally threaded, and said locking means being nut means threadedly secured thereto.

25. The rigging of claim 24 including said nut means having a diameter greater than the exterior diameter of said sleeve.

26. The rigging of claim 24 including said nut means having two interiorly threaded nuts.

27. Rigging for a rowing shell comprising a rigger having a plurality of struts secured to an oarlock pin, a generally tubular member for receiving an oarlock pin, said tubular member being externally threaded and having a generally smooth internal passageway for receipt of said oarlock pin, an oarlock having an internally threaded generally tubular portion in threaded engagement with said tubular member, whereby rotation of said tubular member will effect responsive translational movement of said internally threaded tubular portion of said oarlock, and said threadedly engaged tubular member and tubular portion being structured to move as a unit with respect to said oarlock pin during rowing.

28. The rigging of claim 27 including a knob disposed at the upper end of said generally tubular externally threaded member for effecting rotational movement thereof.

29. The rigging of claim 27 including said externally threaded tubular member being composed of a resinous plastic material.

30. The rigging of claim 28 including said knob being integrally formed with said externally threaded tubular member.

* * * * *